US006221828B1

(12) United States Patent
Matsuo et al.

(10) Patent No.: US 6,221,828 B1
(45) Date of Patent: Apr. 24, 2001

(54) DETERGENT COMPOSITION COMPRISING AN ALKYLPOLYGLYCOSIDE, A GERMICIDE, AND A FATTY ACID SALT

(75) Inventors: Noboru Matsuo; Yoshihiro Yamazaki; Sumitoshi Ito; Takashi Itoi; Toshikazu Azuma, all of Wakayama; Susumu Yamasawa, Tokyo, all of (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/499,742

(22) Filed: Feb. 8, 2000

(30) Foreign Application Priority Data

Feb. 12, 1999 (JP) ..... 11-034559

(51) Int. Cl.[7] ..... C11D 3/22; C11D 1/62; C11D 1/04

(52) U.S. Cl. ..... 510/384; 510/237; 510/238; 510/319; 510/389; 510/362; 510/391; 510/437; 510/470; 510/480; 510/488; 510/491; 510/503; 510/504

(58) Field of Search ..... 510/237, 238, 510/319, 384, 389, 362, 391, 437, 470, 480, 488, 491, 503, 504

(56) References Cited

U.S. PATENT DOCUMENTS

| | | | | |
|---|---|---|---|---|
| 4,606,850 | * | 8/1986 | Malik | 252/528 |
| 4,919,837 | | 4/1990 | Gluck | 252/106 |
| 4,919,846 | * | 4/1990 | Nakama et al. | 252/542 |
| 5,739,168 | * | 4/1998 | Hioki et al. | 514/643 |
| 5,948,742 | * | 9/1999 | Chang et al. | 510/191 |

FOREIGN PATENT DOCUMENTS

| | | |
|---|---|---|
| 44 14 696 | 9/1994 | (DE) . |
| 0 280 550 | 8/1988 | (EP) . |
| 0 427 210 | 5/1991 | (EP) . |
| 0 670 158 | 9/1995 | (EP) . |
| 0 698 660 | 2/1996 | (EP) . |
| 0 864 638 | 9/1998 | (EP) . |
| 0 872 541 | 10/1998 | (EP) . |
| 0 926 231 | 6/1999 | (EP) . |
| 3-127717 | 5/1991 | (JP) . |

* cited by examiner

*Primary Examiner*—Yogendra Gupta
*Assistant Examiner*—Charles Boyer
(74) *Attorney, Agent, or Firm*—Oblon, Spivak, McClelland, Maier & Neustadt, P.C.

(57) ABSTRACT

The detergent composition is excellent in both detergency and sterilizing properties, causes less corrosion and/or damage to plastic and comprises (A) an alkyl polyglycoside, (B) a germicide selected from a cationic germicide, a biguanide germicide and an amino acid germicide and (C) a fatty acid salt respectively at specific proportions.

9 Claims, No Drawings

DETERGENT COMPOSITION COMPRISING AN ALKYLPOLYGLYCOSIDE, A GERMICIDE, AND A FATTY ACID SALT

TECHNICAL FIELD OF INVENTION

The present invention relates to a detergent being excellent in detergency and sterilizing property and causing less corrosion and/or damage to plastic.

PRIOR ART

In washing of hard surface of a plastic, a glass, a metal, a pottery, a tile, a wood, a concrete etc., visually recognizable dirt can be removed by treatment with a detergent. Since removal of microorganisms is not satisfactory, the dirt is first removed with a detergent and a germicide typically such as an alcohol and an invert soap is then used to remove the microorganisms. This method, however, includes two steps of washing and sterilizing, being troublesome. This is the reason another detergent is demanded to conduct washing and sterilization simply at a time.

On the other hand, among materials having hard surface, some kinds of plastic such as ABS resin are poor in chemical resistance and some detergents are found to cause corrosion or damage.

JP-A 3-127717 discloses a detergent for human body including a nonionic surfactant made from sugar and a germicide. DE-A 4414696 shows a detergent for human body containing an alkyl polyglycoside and an anionic, nonionic, cationic or amphoteric surfactant.

DISCLOSURE OF INVENTION

Accordingly, the object of the present invention is to provide a detergent by which washing and sterilization can be effected at a time and no corrosion nor damage to plastic such as ABS resin is recognized.

The invention is a detergent composition comprising (A) 0.01 to 50% by weight of an alkyl polyglycoside, (B) 0.001 to 25% by weight of at least one germicide selected from the group consisting of a cationic germicide, a biguanide germicide and an amino acid germicide and (C) a fatty acid salt at a ratio by weight of (B) /(C) in the range of from 100/0.1 to 100/20.

The component(B) is preferably a cationic germicide.

The composition preferably comprises 0.01 to 15% by weight of (A) and 0.01 to 10% by weight of a cationic germicide (B) at a ratio of (B)/(C) being from 100/1 to 100/10.

The invention further provides a method of washing a hard surface with the above shown composition and use of the composition as a detergent for a hard surface.

DETAILED EXPLANATION OF INVENTION

The component (A) is preferably an alkyl polyglycoside represented by the following formula (A-1):

$$R^1(OR^2)_xG_y \qquad \text{(A-1)}$$

wherein $R^1$ represents a straight-chained or branched, $C_8$ to $C_{18}$, preferably $C_{10}$ to $C_{14}$, alkyl group or alkenyl group, or an alkylphenyl group; $R^2$ represents a $C_2$ to $C_4$ alkylene group; G is a residue derived from $C_5$ to $C_6$ reducing sugar, preferably from glucose; x is a number from 0 to 5, preferably 0, on the average and y is a number from 1 to 10, preferably 1.1 to 2.0, on the average.

The content of the blended component (A) is 0.01 to 50% by weight, preferably 0.1 to 15% by weight.

In addition, the component (B) of a cationic germicide is preferably a cationic surfactant represented by the following formula (B-1) or (B-2), a biguanide germicide and an amino acid germicide:

(B-1)

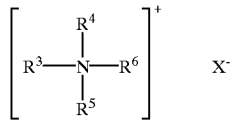

(B-2)

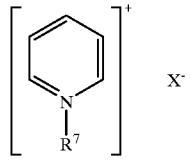

wherein one or two of $R^3$ to $R^6$ groups represent a $C_8$ to $C_{16}$ straight-chained or branched alkyl group or alkenyl group, or a group represented by the following formula:

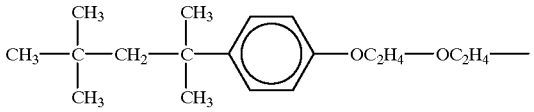

and the others are the same as or different from one another and represent a $C_1$ to $C_3$ alkyl group, a benzyl group or a group represented by the formula of $—(CH_2CH_2O)_mH$ (m, being an average mole number of added ethylene oxide, is 2 to 20); $R^7$ represents a $C_{12}$ to $C_{18}$ straight-chained or branched alkyl group or alkenyl group and X represents a halogen atom, preferably chlorine, or a group forming an organic anion.

Concretely are included cationic surfactant germicides such as a dialkyldimethyl ammonium halide, a benzalkonium chloride, benzethonium chloride and a derivative thereof having a counter ion substituted by another anion; biguanide germicides such as chlorhexidine and chlorhexidine gluconate; and amino acid germicides such as an alkyl-diaminoethyl glycine and an alkylpolyaminoethyl glycine. In view of both detergency and sterilizing property, those represented by formula (B-1) wherein each of two of $R^3$ to $R^6$ groups is a $C_8$ to $C_{10}$ straight-chained alkyl group and the others are methyl group are most preferable.

The amount of the blended component (B) is 0.001 to 25 by weight, preferably 0.01 to 10% by weight.

The component (C) is preferably a $C_6$ to $C_{18}$ straight-chained or branched, saturated or unsaturated fatty acid salt. More preferably is it a $C_8$ to $C_{12}$ straight-chained fatty acid salt. The counter ion for salt preferably includes an alkali metal such as sodium and potassium, an alkaline earth metal such as magnesium and calcium and an alkanolamine such as monoethanolamine, diethanolamine and triethanolamine. In view of solubility, sodium, potassium and an aklanolamine are more preferable. Potassium and an alkanolamine are most preferable.

From the viewpoint of blending stability, it is preferably an alkanolamine salt such as a monoethanolamine salt and a diethanolamine salt. A preferable fatty acid salt has an alkyl or alkenyl having 6 to 18 carbon atoms.

To increase the detergency without any deterioration of the sterilizing property, the component (C) is blended with the component (B) at a ratio of (B)/(C) by weight in the range of from 100/0.1 to 100/20, preferably 100/1 to 100/10.

Further, an alkyldimethylamine oxide (D) represented by the formula (I) below may be added to the detergent of the present invention to improve a blending stability and increase detergency:

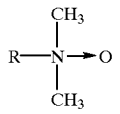

(I)

in which R represents a $C_8$ to $C_{18}$ straight-chained or branched alkyl group or alkenyl group.

In the formula (I), R is preferably a $C_{10}$ to $C_{14}$ straight-chained alkyl group. The amount of the blended alkyldimethylamine oxide is preferably 0.5 to 10% by weight, more preferably 1 to 5% by weight.

From the viewpoint of easiness in use, the detergent of the present invention is preferably an aqueous liquid detergent comprising the components (A) to (C) dissolved or dispersed in an aqueous medium.

For improvement in detergency and blending stability, a rust preventive is preferably added to the detergent of the present invention in order to prevent corrosion when a metal chelating agent (E), a water-soluble solvent, an alkaline agent or a halogen-containing cationic germicide is used.

The metal chelating agent used is a hydroxycarboxylic acid or a salt thereof or an aminocarboxylic acid or a salt thereof. In particular, are preferably ethylenediamine tetraacetic acid, hydroxyethyl ethylenediamine triacetic acid, nitrilotriacetic acid, citric acid and a salt of them. The metal chelating agent is incorporated preferably in an amount of 1 to 30 parts by weight, more preferably 5 to 20 parts by weight to 100 parts by weight of the component (B).

The water-soluble solvent includes a $C_1$ to $C_5$ monohydric alcohol such as ethanol, a $C_2$ to $C_{12}$ dihydric alcohol such as ethylene glycol and a polyalkylene glycol alkyl ether such as diethylene glycol monoethyl ether. The amount of the water-soluble solvent is preferably 0.01 to 30% by weight, more preferably 0.1 to 10% by weight.

The alkaline agent used includes a hydroxide, carbonate, sulfate or silicate of an alkali metal or an alkanolamine etc. In particular monoethanolamine is preferable because of its high detergency and its low residual degree. The amount of the blended alkaline agent is preferably 0.01 to 30% by weight, more preferably 0.1 to 10% by weight.

The rust preventive includes compounds such as silicates, benzoates, nitrites, benzotriazole and benzothiazole. In particular nitrites are preferable.

Perfumes, dyestuffs, pigments etc. may be added, if necessary, to the detergent of the present invention.

The detergent being excellent in both detergency and sterilizing property and causing less corrosion or damage to plastic, particularly ABS resin, can be obtained according to the present invention.

EXAMPLE

Examples 1 to 5 and Comparative Examples 1 to 5

The detergents shown in Table 1 were prepared and evaluated in detergency, sterilizing property and influence on plastic. Results are shown in Table 1.

<Evaluation of detergency>Leenerts-modified washing test method using oil 300 g of chloroform and 0.3 g of Sudan III were added to a mixed oil of 180 g of molten tallow and 20 g of rapeseed oil. Having been filtered with a gauze, a model of oily dirt was prepared.

A 30×80×1 mm sized test piece of polyethylene was prepared, in advance cleaned with hexane. One set of 6 pieces was weighed as tare weight. One sheet of the test pieces was immersed for 2 seconds in the above-mentioned model oily dirt to have the dirt adhere up to nearly 50 mm of the test piece. The excess dirt adhering to the lower end portion of the test piece was soaked up with paper. Thereafter, the resulting piece was air-dried at 25±2° C. and weighed to find the weight before washing. The test piece to which the model oily dirt had adhered was set in Leenerts-modified washing machine and washed with a cleaning fluid including the detergent at an adjusted concentration of 1% (25±2° C.). After 1 minute, the test piece was taken out, air-dried and weighed. The detergency was calculated according to the following equation. Detergency for 6 pieces were calculated per each detergent. Their average was used for evaluation.

$$\text{Detergency (\%)} = \frac{(\text{weight before washing}) - (\text{weight after washing})}{(\text{weight before washing}) - (\text{weight of tare weight})} \times 100$$

<Evaluation of sterilizing property>Minimum bactericidal concentration in a microplanter method A diluted sample of each detergent was prepared. The maximum degree of dilution at which the detergent could kill 100% of test microorganisms (Escherichia coli IFO 3972, Pseudomonas aeruginosa IFO 12732) was determined. That is, 0.1 ml of the microorganisms (about $10^9$ to $10^{10}$ cells/ml), pre-cultured in SCD medium, was taken and brought for 60 seconds intd contact with 10 ml of a diluted sample prepared by diluting the detergent in 3.5 DH hard water in which microorganisms were pre-killed. The sample was taken in an amount of one platinum loop and inoculated onto a laboratory micro-petri-dish (product of CORNING Ltd., 96-Cell Wells) containing 0.3 ml of SCD medium for post-culture. It was cultured at 30° C. for 3 days. The maximum degree of dilution at which the growth of the microorganism on the microplanter had not been observed was determined. The higher the degree of dilution is, the higher the bactericidal effect is.

<Evaluation of influence on plastic>

A wad of sanitary cotton impregnated with 0.5 g of a detergent was placed on a 10×7×1 mm sized test piece made of ABS resin and then allowed to stand for 24 hours at 25±2° C. It was visually observed and evaluated according to the following criteria.

Evaluation criteria:

○: The test piece has not changed and was not broken even upon added stress.

Δ: The test piece has not changed in appearance, but was broken under added stress.

×: Cracks were observed in the test piece.

TABLE 1

| | Examples | | | | | Comparative Examples | | | | |
|---|---|---|---|---|---|---|---|---|---|---|
| | 1 | 2 | 3 | 4 | 5 | 1 | 2 | 3 | 4 | 5 |
| Blending Amount (weight-%) | | | | | | | | | | |
| The component (A) APG | 5 | 5 | 5 | 5 | 5 | 5 | | | | |
| Comparative nonionic surfactant | | | | | | | | | 5 | 5 |
| The component (B) | | | | | | | | | | |
| b-1 | 5 | | 5 | 5 | 5 | 5 | 5 | | | 5 |
| b-2 | | 5 | | | | | | 5 | 5 | |
| The component (C) | | | | | | | | | | |
| Caprylic acid monoethanolamine salt | 0.2 | 0.2 | 0.2 | | 0.2 | 2 | | | | |
| Caprylic acid potassium salt | | | | 0.2 | | | | | | |
| The component (D) Dodecyldimethylamine oxide | | | 3 | | 3 | | | | | |
| The component (E) Trisodium ethylenediaminetetraacetate · $3H_2O$ | | | | | 0.2 | | | | | |
| Deionized water | Balance | Balance | Balance | Balance | Balance | Balance | Balance | Balance | Balance | Balance |
| Detergency (%) | 58 | 43 | 68 | 68 | 69 | 39 | 31 | 13 | 4 | 8 |
| Sterilizing property (maximum degree of dilution) | × 10000 | × 5000 | × 10000 | × 10000 | × 10000 | × 1000 | × 10000 | × 5000 | × 5000 | × 10000 |
| Influence on plastic | ○ | ○ | ○ | ○ | ○ | ○ | ○ | ○ | Δ | Δ |

*balance: The amount by which the total amount is made 100% by weight (this applies hereinafter).

Each component used in Table 1 is as follow.

The component (A)

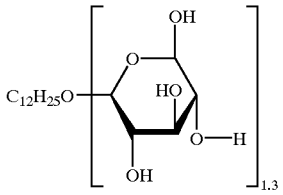

APG

The component (B)

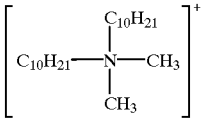

b-1

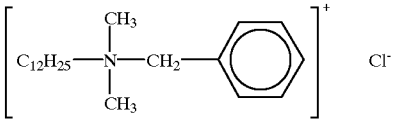

b-2

Comparative nonionic surfactant: $C_{12}H_{25}O(C_2H_4O)_9H$ (Softanol 90, Nippon Shokubai Co., Ltd.)

Examples 6 to 9

A detergent for kitchen shown in Table 2 was prepared and evaluated in the same manner as in Example 1. Results are shown in Table 2.

TABLE 2

| | Example 6 | Example 7 | Example 8 | Example 9 |
|---|---|---|---|---|
| Blending amount (weight-%) | | | | |
| The component (A) APG | 5 | 5 | 5 | 5 |
| The component (B) b-1 | 5 | 5 | 5 | 5 |
| The component (C) | | | | |
| Caprylic acid monoethanolamine salt | 0.2 | | 0.2 | 0.2 |
| Caprylic acid potassium salt | | 0.2 | | |
| The component (D) Dodecyldimethylamine oxide | 3 | | 3 | 3 |
| The component (E) Trisodium ethylenediaminetetraacetate · $3H_2O$ | 0.2 | | | 0.2 |
| Ethanol | 5 | 5 | 5 | 5 |
| Monoethanolamine | 3 | 3 | 3 | 3 |
| Sodium nitrite | 0.2 | | | |
| Deionized water | Balance | Balance | Balance | Balance |
| Detergency (%) | 70 | 70 | 69 | 68 |
| Sterilizing property (maximum degree of dilution) | × 10000 | × 10000 | × 10000 | × 10000 |
| Influence on plastic | ○ | ○ | ○ | ○ |

What is claimed is:

1. A detergent composition comprising (A) 0.01 to 50% by weight of an alkyl polyglycoside, (B) 0.001 to 25% by weight of at least one germicide selected from the group consisting of a cationic germicide, a biguanide germicide and an amino acid germicide, and (C) a fatty acid salt, at a ratio by weight of (B)/(C) in the range of from 100/0.1 to 100/20.

2. The composition as claimed in claim 1, which further comprises an alkyldimethylamine oxide (D) represented by the following formula (I):

(I)

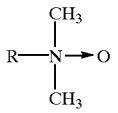

in which R represents a $C_8$ to $C_{18}$ straight-chained or branched alkyl group or alkenyl group.

3. The composition as claimed in claim 1, in which the component (A) is an alkyl polyglycoside represented by the following formula (A-1):

$$R^1(OR^2)_xG_y \quad \text{(A-1)}$$

wherein $R^1$ represents a straight-chained or branched $C_8$ to $C_{18}$ alkyl group or alkenyl group, or an alkylphenyl group; $R^2$ represents a $C_2$ to $C_4$ alkylene group; G is a residue derived from a $C_5$ to $C_6$ reducing sugar; x is a number from 0 to 5 on the average and y is a number from 1 to 10 on the average.

4. The composition as claimed in claim 1, in which the component (B) is a cationic surfactant represented by the following formula (B-1) or (B-2):

(B-1)

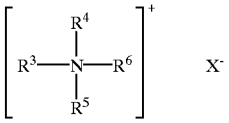

(B-2)

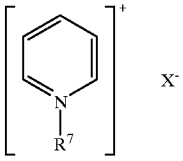

in which one or two of $R^3$, $R^4$, $R^5$ and $R^6$ groups represent a $C_8$ to $C_{16}$ straight-chained or branched alkyl group or alkenyl group, or a group represented by the following formula:

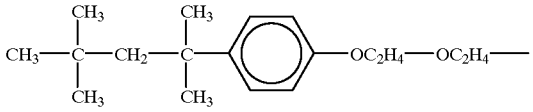

and the others, being the same as or different from one another, represent a $C_1$ to $C_3$ alkyl group, a benzyl group or a group represented by the formula of $—(CH_2CH_2O)_mH$, m being 2 to 20 and an average mole number of added ethylene oxide; $R^7$ represents a $C_{12}$ to $C_{18}$ straight-chained or branched alkyl group or alkenyl group and X represents a halogen atom or a group forming an organic anion.

5. The composition as claimed in claim 1, in which the component (C) has an aliphatic group of an alkyl or alkenyl having 6 to 18 carbon atoms and is a salt with an alkali metal, an alkaline earth metal or an alkanolamine.

6. The composition as claimed in claim 1, which further comprises a chelating agent (E).

7. The composition as claimed in claim 1, which comprises 0.01 to 15 percent by weight of (A) and 0. 01 to 10 percent by weight of a cationic germicide (B) at a ratio of (B)/(C) being from 100/1 to 100/10.

8. The composition as claimed in claim 1, in which the component (B) is a cationic surfactant.

9. A method of washing a hard surface with the composition as defined in claim 1.

* * * * *